US010714277B2

(12) United States Patent
Lin

(10) Patent No.: US 10,714,277 B2
(45) Date of Patent: Jul. 14, 2020

(54) KEY DEVICE HAVING A REINFORCED STRUCTURE AND METHOD OF MAKING THE SAME

(71) Applicant: Sunrex Technology Corp., Taichung (TW)

(72) Inventor: Shih-Pin Lin, Taichung (TW)

(73) Assignee: SUNREX TECHNOLOGY CORP., Taichung (TW)

( * ) Notice: Subject to any disclaimer, the term of this patent is extended or adjusted under 35 U.S.C. 154(b) by 0 days.

(21) Appl. No.: 16/193,409

(22) Filed: Nov. 16, 2018

(65) Prior Publication Data

US 2020/0020491 A1 Jan. 16, 2020

(30) Foreign Application Priority Data

Jul. 11, 2018 (TW) ..... 107209362 U

(51) Int. Cl.

| | |
|---|---|
| ***H01H 13/14*** | (2006.01) |
| ***H01H 13/10*** | (2006.01) |
| ***H01H 13/04*** | (2006.01) |
| ***H01H 11/00*** | (2006.01) |

(52) U.S. Cl.

CPC ..... *H01H 13/10* (2013.01); *H01H 11/00* (2013.01); *H01H 13/04* (2013.01); *H01H 13/14* (2013.01); *H01H 2233/03* (2013.01); *H01H 2233/07* (2013.01)

(58) Field of Classification Search

CPC ..... H01H 3/125; H01H 13/83; H01H 13/704; H01H 13/702; H01H 13/703; H01H 13/14; H01H 3/122; H01H 13/02; H01H 13/10; H01H 13/7006; H01H 13/785; H01H 13/79; H01H 13/80; H01H 13/803; H01H 11/00; H01H 13/04; H01H 2233/07; H01H 2233/03

See application file for complete search history.

(56) References Cited

U.S. PATENT DOCUMENTS

| | | | | |
|---|---|---|---|---|
| 6,759,614 | B2 * | 7/2004 | Yoneyama | H01H 3/125 200/344 |
| 9,640,347 | B2 * | 5/2017 | Kwan | B05D 5/06 |
| 2003/0169232 | A1 * | 9/2003 | Ito | G06F 3/0202 345/156 |
| 2013/0098743 | A1 * | 4/2013 | Kuo | G06F 3/0221 200/5 A |
| 2015/0090571 | A1 * | 4/2015 | Leong | H01H 13/83 200/5 A |
| 2016/0055989 | A1 * | 2/2016 | Hsu | H01H 13/14 200/344 |
| 2016/0148763 | A1 * | 5/2016 | Chen | H01H 13/705 200/341 |

* cited by examiner

*Primary Examiner* — Ahmed M Saeed
(74) *Attorney, Agent, or Firm* — Husch Blackwell LLP

(57) ABSTRACT

A key device includes a key cap and a base plate unit. The key cap includes a top wall and a peripheral wall cooperatively defining a receiving space. The top wall has a plurality of spaced-apart studs protruding into the receiving space. The base plate unit is disposed in the receiving space and is riveted to the top wall through the studs. The base plate unit includes a base plate, and a plurality of engaging members secured to the base plate. The base plate includes a plurality of stud holes for extension of the studs respectively therethrough, and a plurality of spaced-apart anchor members. The engaging members are injection molded to the anchor members, respectively.

7 Claims, 10 Drawing Sheets

KEY DEVICE HAVING A REINFORCED STRUCTURE AND METHOD OF MAKING THE SAME

CROSS-REFERENCE TO RELATED APPLICATION

This application claims priority to Taiwanese Patent Application No. 107209362, filed on Jul. 11, 2018.

FIELD

The disclosure relates to a key device of a keyboard, more particularly to a key device having a reinforced structure and a method of making the same.

BACKGROUND

A key device, as disclosed in Taiwanese Patent Publication No. 201432757, includes a base plate, a key cap, and a metal plate body. The metal plate body is connected to a bottom portion of the key cap, and is provided with a plurality of hook members formed by stamping for pivot connection of a plurality of balance bars. However, the hook members cannot be formed into desired shapes by one stamping, and may have to go through several times of stamping, so that the making of the key device is complicated, thereby increasing the manufacturing cost thereof.

SUMMARY

Therefore, an object of the present disclosure is to provide a key device that has a reinforced structure and that is capable of alleviating at least one of the drawbacks of the prior art.

Another object of this disclosure is to provide a method of making the key device having the reinforced structure.

According to one aspect of this disclosure, a key device includes a key cap and a base plate unit. The key cap is made of plastic and includes a top wall and a peripheral wall extending downwardly from a periphery of the top wall and cooperating with the same to define a receiving space. The top wall has a plurality of spaced-apart studs protruding into the receiving space. The base plate unit is disposed in the receiving space and is riveted to the top wall through the studs. The base plate unit includes a base plate made of metal, and a plurality of engaging members secured to the base plate. The base plate includes a plurality of stud holes for extension of the studs respectively therethrough, and a plurality of spaced-apart anchor members. The engaging members are injection molded to the anchor members, respectively.

According to another aspect of this disclosure, a method of making a key device includes the steps of: (A) preparing a key cap and a base plate unit, the key cap being made of plastic and including a top wall and a peripheral wall extending downwardly from a periphery of the top wall and cooperating with the same to define a receiving space, the top wall having a plurality of spaced-apart studs protruding into the receiving space and having straight tubular shapes, the base plate unit including a base plate made of metal, and a plurality of engaging members secured to the base plate, the base plate including a plurality of stud holes and a plurality of spaced-apart anchor members, the engaging members being injection molded to the anchor members, respectively, each engaging member having an engaging portion; (B) placing the base plate unit in the receiving space such that the studs extend respectively through the stud holes; and (C) heating and melting one end of each stud such that the shape of each stud is changed from the straight tubular shape to a rivet shape, thereby riveting the base plate unit to the key cap, each stud after heating having a shank portion protruding from the top wall, and a head portion connected to the shank portion opposite to the top wall and abutting against a lower side surface of the base plate which is opposite to the top wall.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
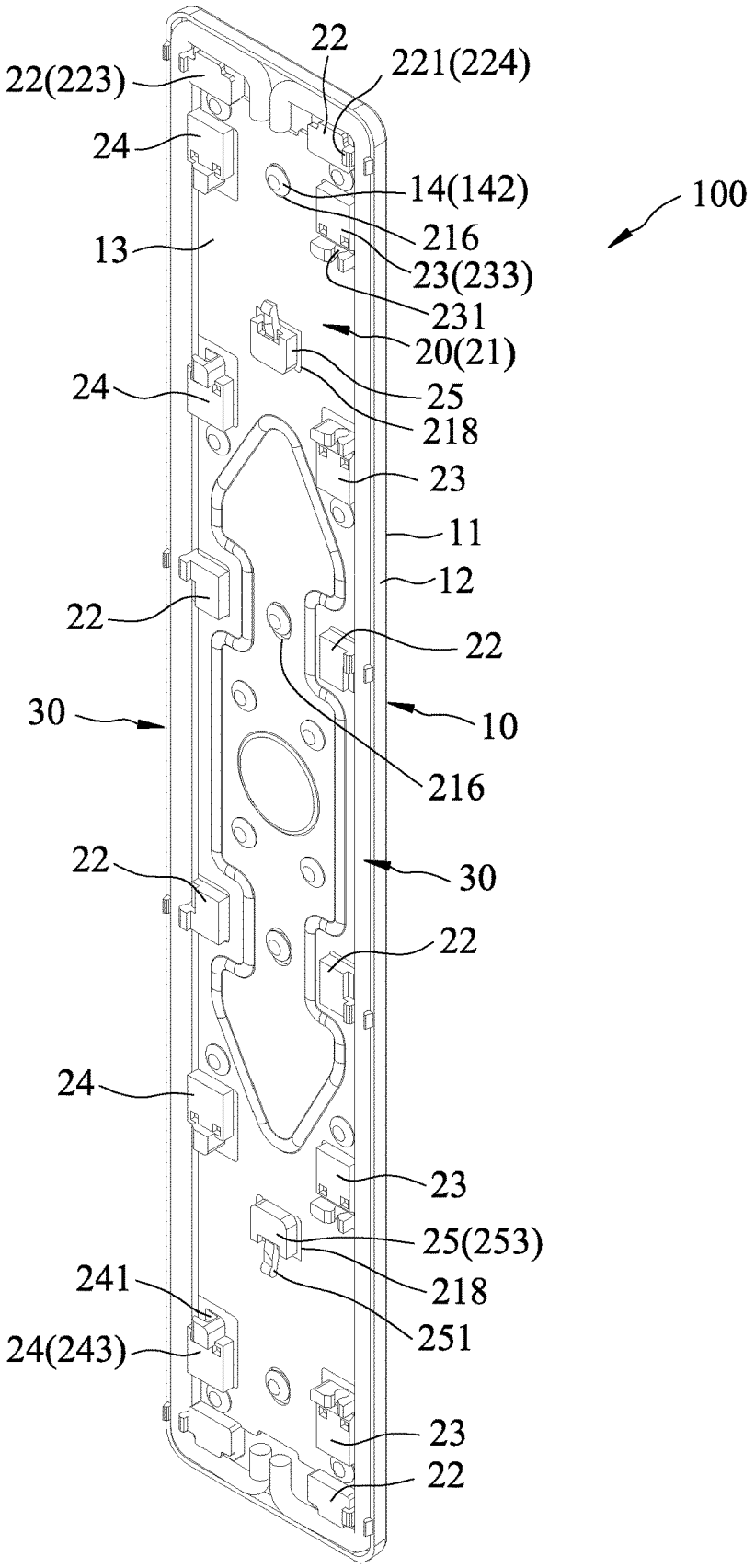
FIG. 1 is a perspective view of a key device according to the embodiment of this disclosure.
Figure 2:
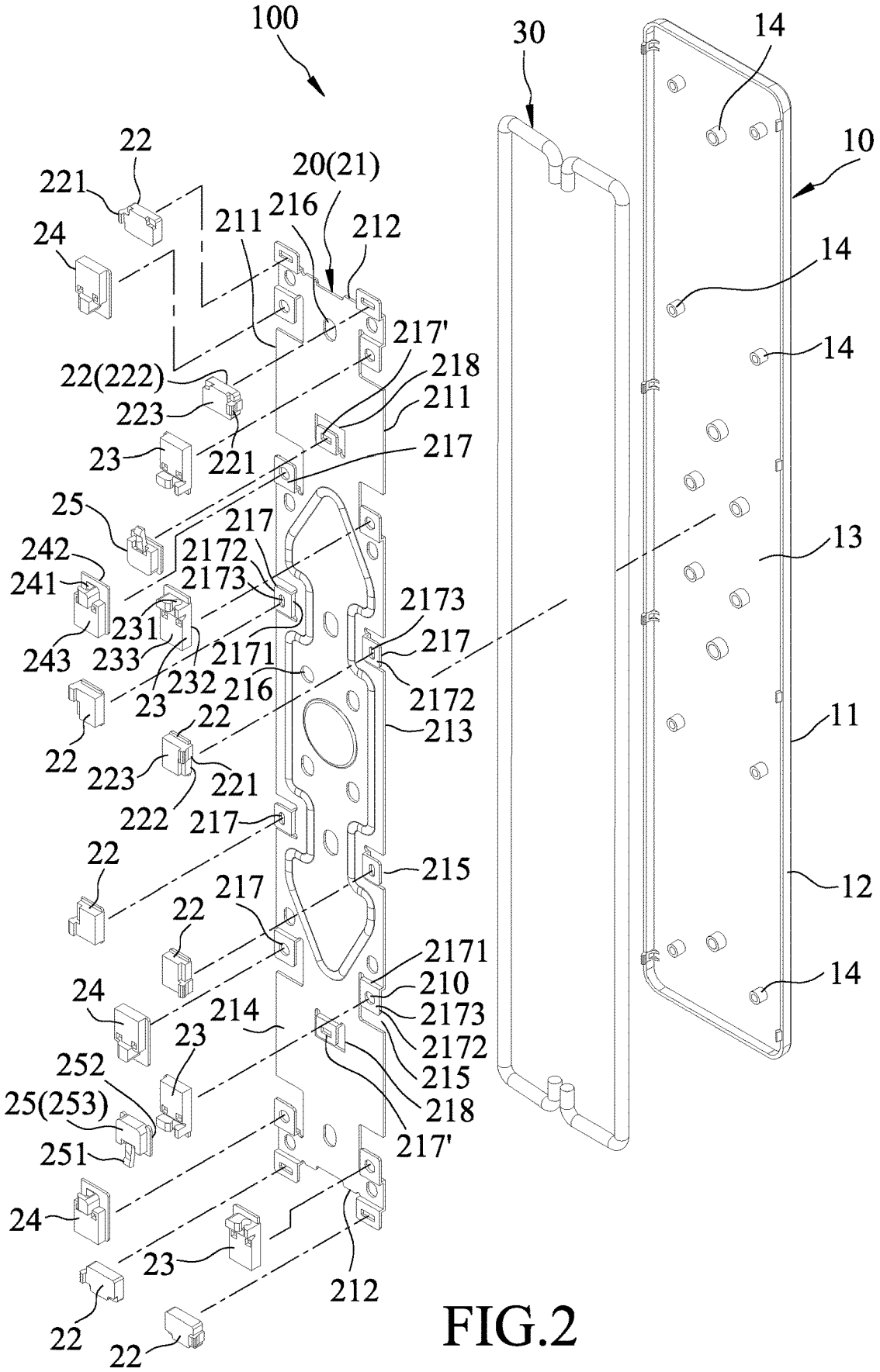
FIG. 2 is an exploded perspective view of FIG. 1.
Figure 3:
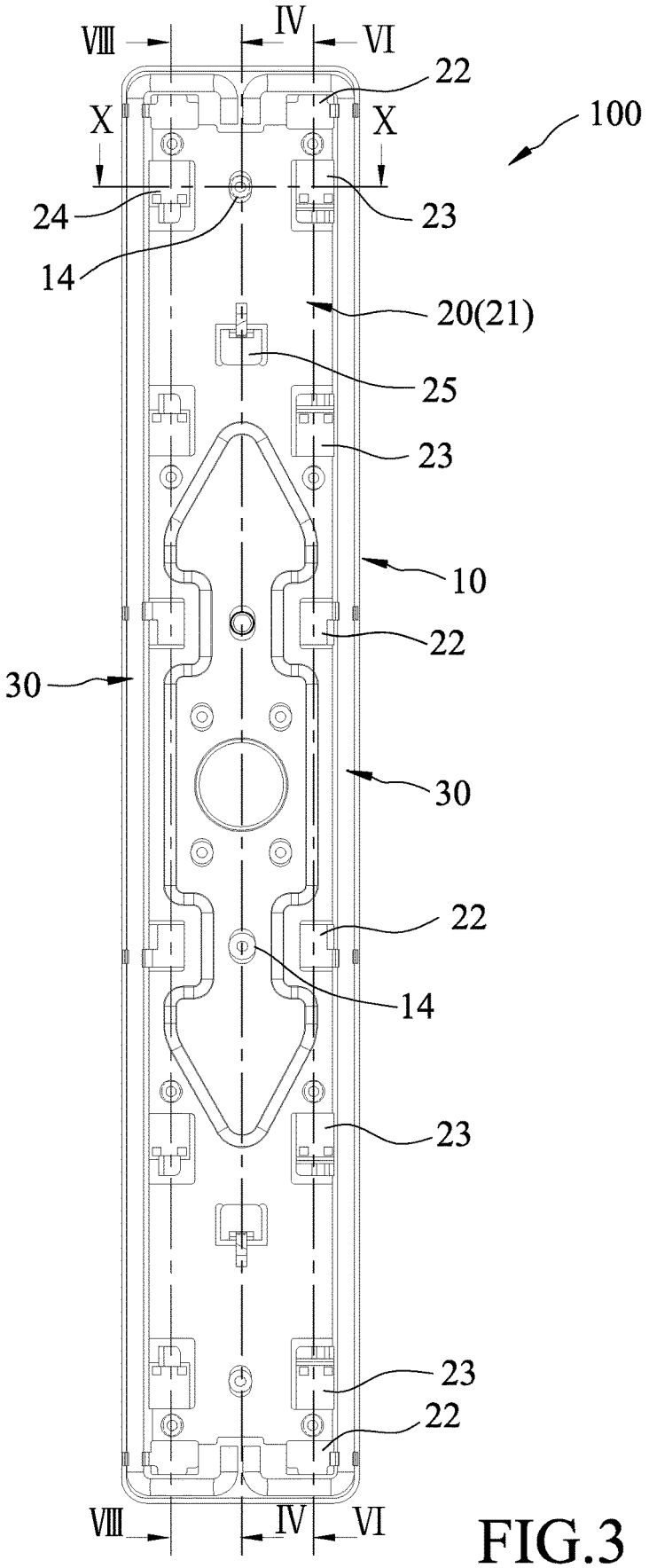
FIG. 3 is an assembled schematic view of the embodiment.

Referring to FIGS. 1 to 3, a key device 100 according to the embodiment of the present disclosure is shown to include a key cap 10, a base plate unit 20 and a pair of balance bars 30.

Figure 7:
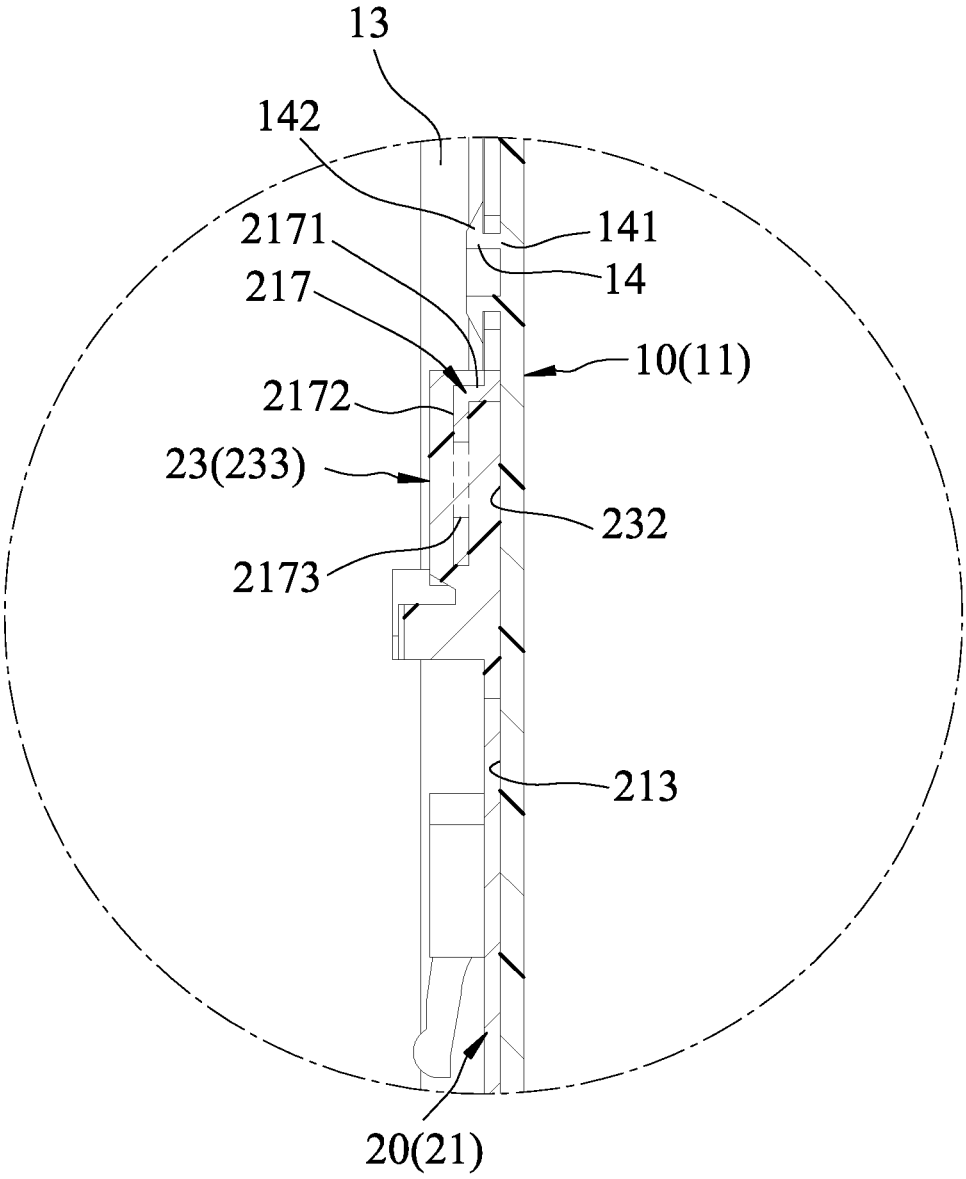
FIG. 7 is an enlarged view of an encircled portion of FIG. 6.
Figure 9:
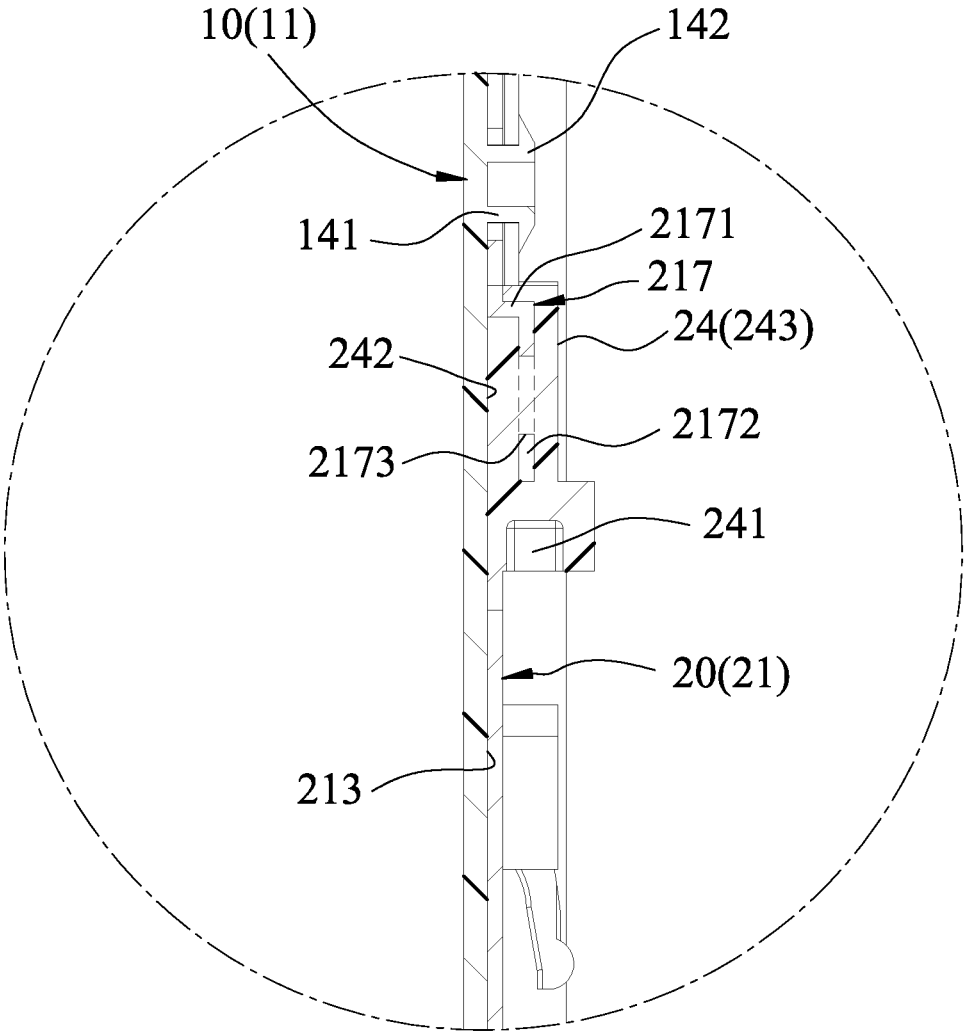
FIG. 9 is an enlarged view of an encircled portion of FIG. 8.
Figure 10:
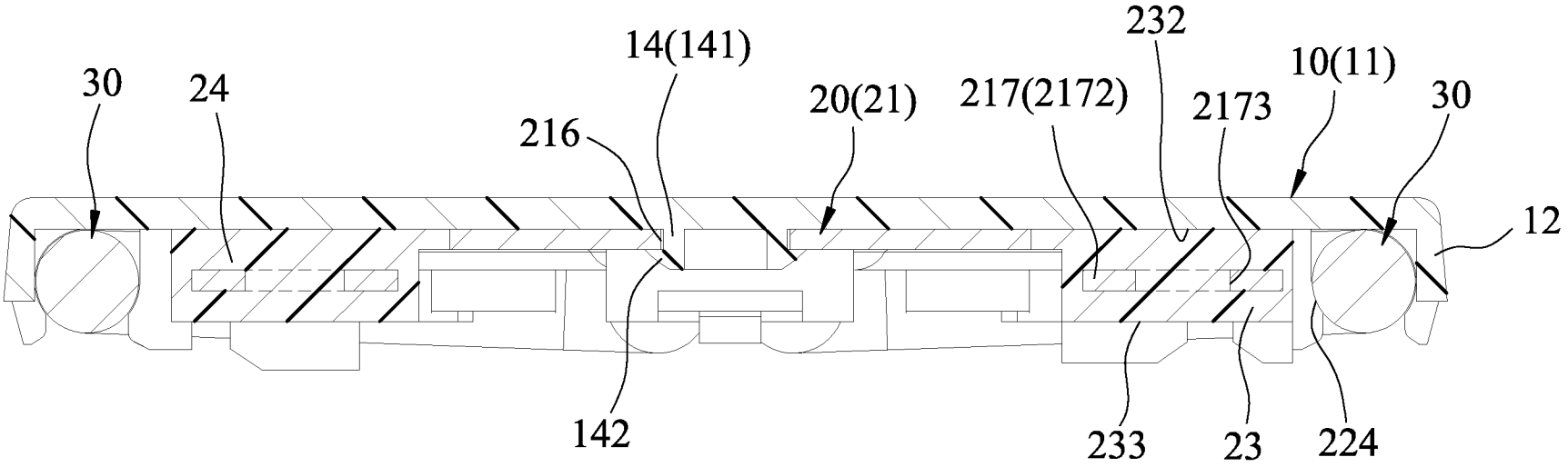
FIG. 10 is a sectional view taken along line X-X of FIG. 3.

The key cap 10 is made of plastic, and includes a top wall 11 and a peripheral wall 12 extending downwardly from a periphery of the top wall 11 and cooperating with the same to define a receiving space 13 that opens in one direction. The top wall 11 has a plurality of spaced-apart studs 14 protruding into the receiving space 13. The shape of each stud 14 can be formed from an original straight tubular shape (see FIG. 2) to a rivet shape (see FIGS. 1, 7 and 9) by heating and melting one end of each stud 14. As shown in FIGS. 7 and 9, each stud 14 in the rivet shape has a shank portion 141 protruding from the top wall 11, and a head portion 142 connected to the shank portion 141 opposite to the top wall 11.

The base plate unit 20 is disposed in the receiving space 13, and is riveted to the top wall 11 through the studs 14. The base plate unit 20 includes a base plate 21 made of metal, and a plurality of engaging members 22, 23, 24, 25 secured to the base plate 21.

The base plate 21 has two opposite long side edges 211, two short side edges 212 connected between the long side edges 211, an upper side surface 213 abutting against the top wall 11, and a lower side surface 214 opposite to the upper side surface 213. The head portion 142 of each stud 14 abuts against the lower side surface 214. The base plate 21 includes a plurality of spaced-apart hollows 215 extending through the upper and lower side surfaces 213, 214, a plurality of stud holes 216 extending through the upper and lower side surfaces 213, 214 for extension of the studs 14 respectively therethrough, two through holes 218 extending through the upper and lower side surfaces 213, 214 and respectively proximate to the short side edges 212, and a plurality of spaced-apart anchor members 217, 217'.

In this embodiment, the hollows 215 are in the form of notches that extend inwardly from the long side edges 211. The base plate 21 is punched and stamped to form the hollows or notches 215, the through holes 218 and the anchor members 217, 217'. Each anchor member 217, 217' has a first plate portion 2171 connected transversely to the lower side surface 214, and a second plate portion 2172 connected transversely to the first plate portion 2171 and formed with an aperture 2173. The second plate portion 2172 is spaced apart from the lower side surface 214. The first and second plate portions 2171, 2172 form an L-shape in cross section. The second plate portions 2172 of the anchor members 217 correspond in position to the respective notches 215. The second plate portions 2172 of the anchor members 217' correspond in position to the respective through holes 218.

The engaging members 22, 23, 24, 25 are injection molded to the respective anchor members 217, 217'. Each engaging member 22, 23, 24, 25 has an engaging portion 221, 231, 241, 251, a first end face 222, 232, 242, 252 flush with the upper side surface 213, and a second end face 223, 233, 243, 253 opposite to the first end face 222, 232, 242, 252. The engaging portions 221 of the engaging members 22 are adjacent to the peripheral wall 12 and cooperate with the peripheral wall 12 to form a plurality of pivot engaging portions 224 (see FIG. 1). The engaging members 23, 24, 25 are located between the long side edges 211. The engaging portion 231 of each engaging member 23 is a C-shaped groove. The engaging portion 241 of each engaging member 24 is a slide groove. The engaging portion 251 of each engaging member 25 is a hook rod.

Figure 4:
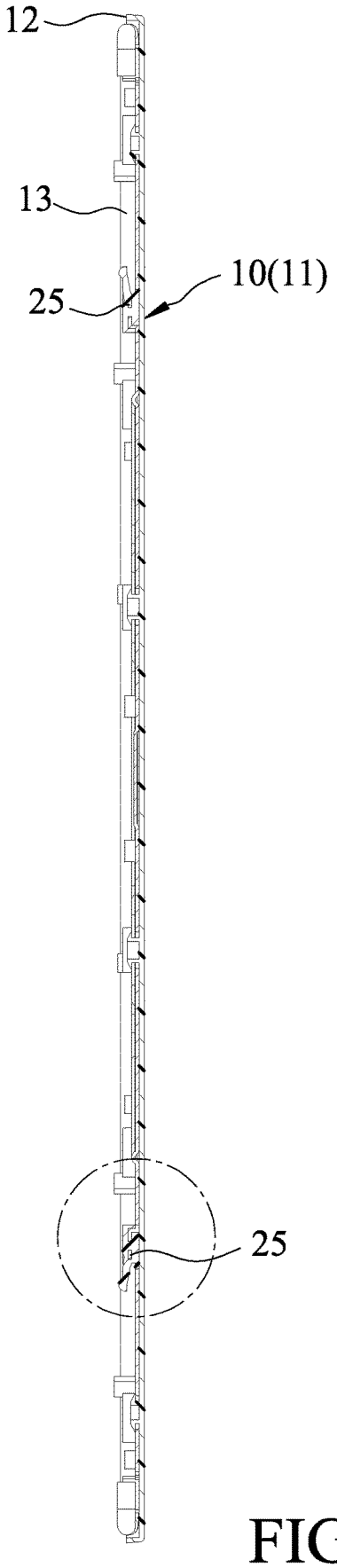
FIG. 4 is a sectional view taken along line IV-IV of FIG. 3.
Figure 5:
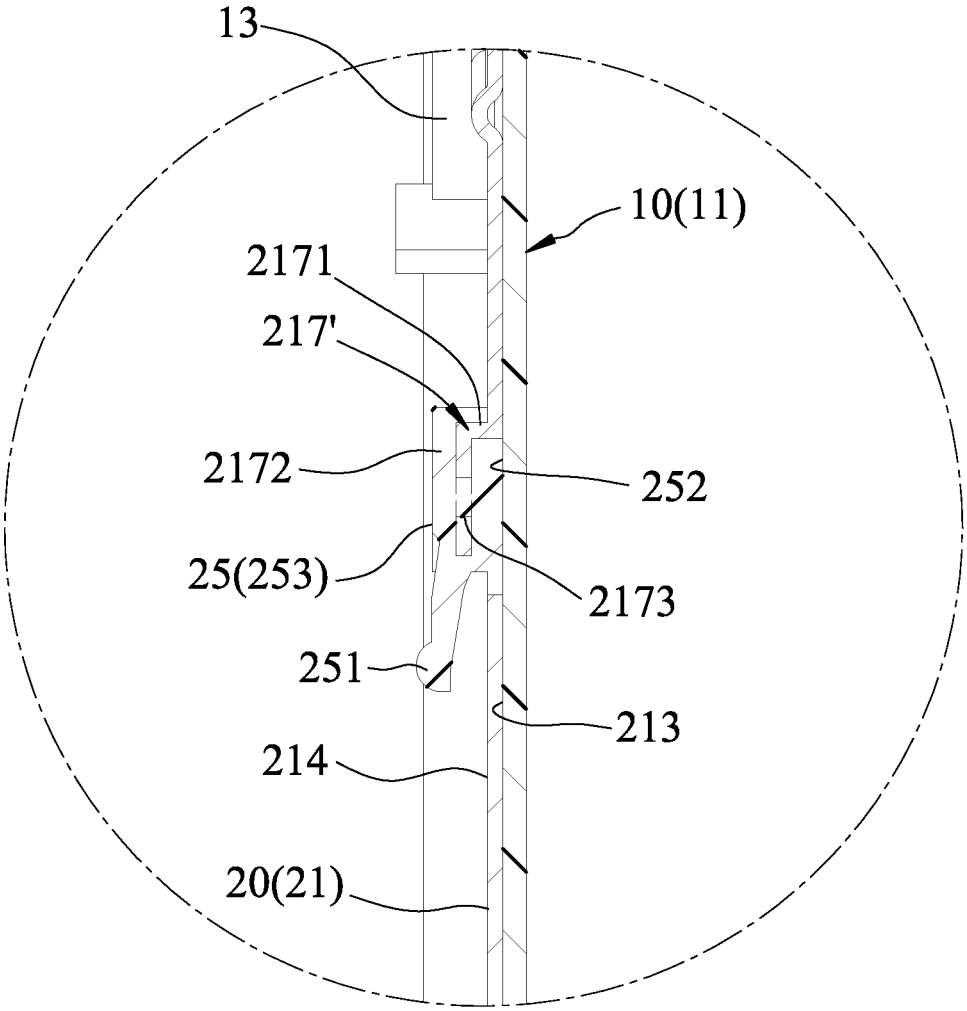
FIG. 5 is an enlarged view of an encircled portion of FIG. 4.
Figure 6:
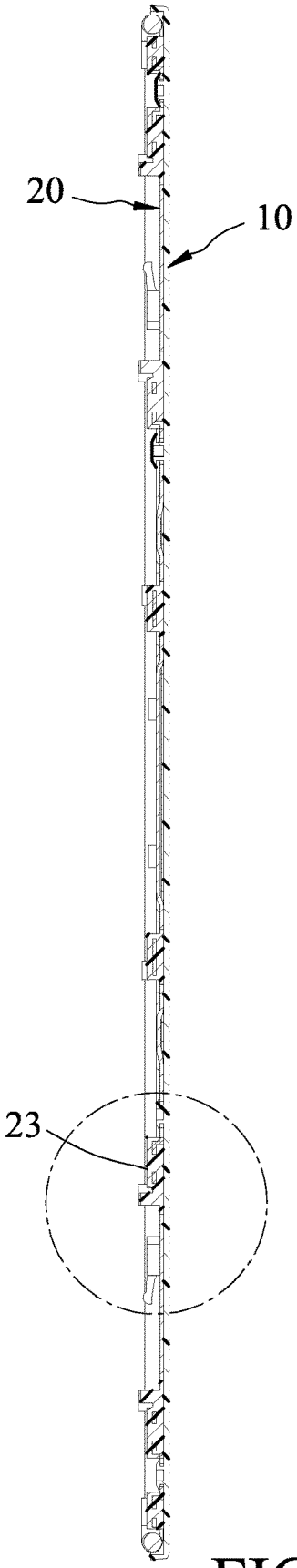
FIG. 6 is a sectional view taken along line VI-VI of FIG. 3.
Figure 8:
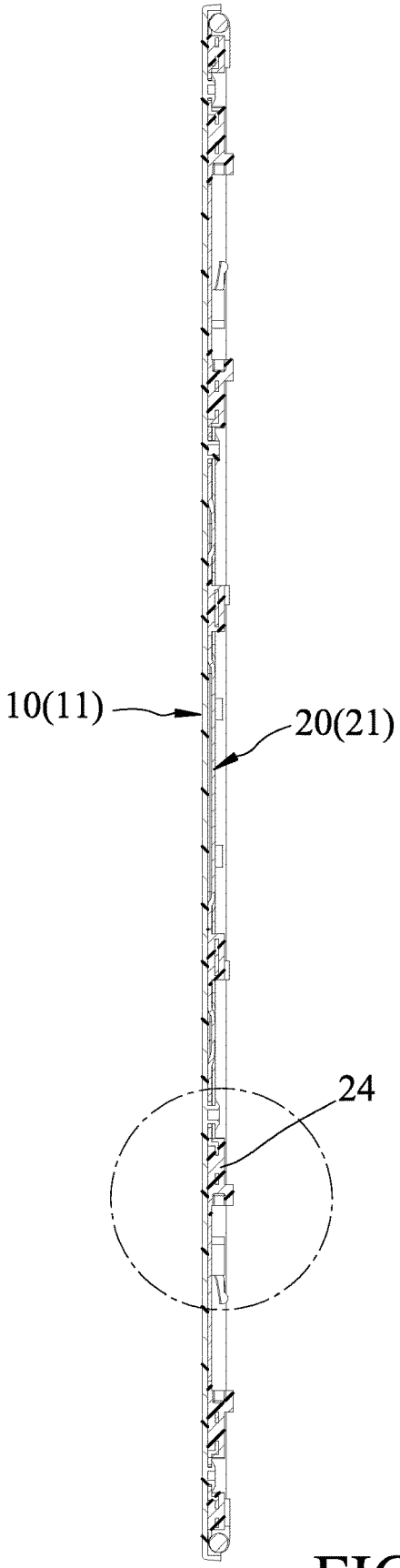
FIG. 8 is a sectional view taken along line VIII-VIII of FIG. 3.

The second plate portion 2172 of each anchor member 217, 217' is located between the first end face 222, 232, 242, 252 and the second end face 223, 233, 243, 253 of the respective engaging member 22, 23, 24, 25 when each engaging member 22, 23, 24, 25 is injection molded to the respective anchor members 217, 217', and the aperture 2173 is filled with plastic material to anchor each engaging member 22, 23, 24, 25 to the respective anchor member 217, 217'. The cross-sectional structure of each engaging member 24 is shown in FIGS. 8 and 9, the cross-sectional structure of each engaging member 23 is shown in FIGS. 6 and 7, and the cross-sectional structure of each engaging member 25 is shown in FIGS. 4 and 5.

The balance bars 30 correspond in position to the long side edges 211, and are pivotally engaged to the pivot engaging portions 224.

As shown in FIGS. 1 and 3 to 10, a method of making the key device 100 of this embodiment includes the following steps:

Step 1: preparing the key cap 10, the base plate unit 20, and the pair of balance bars 30.

The key cap 10 defines the receiving space 13 and has the studs 14 in the original straight tubular shapes. The base plate unit 20 includes the base plate 21 and the engaging members 22, 23, 24, 25. The base plate 21 is made of metal, and is preformed with the notches 215, the stud holes 216, the through holes 218 and the anchor members 217, 217' by punching and stamping. The engaging members 22, 23, 24, 25 are injection molded to the respective anchor members 217, 217' such that the second plate portion 2172 of each anchor member 217, 217' is embedded in the respective engaging member 22, 23, 24, 25, and the aperture 2173 is filled with plastic material to anchor each engaging member 22, 23, 24, 25 to the respective anchor member 217, 217'. Each engaging member 22, 23, 24, 25 has an engaging portion 221, 231, 241, 251.

Step 2: placing the base plate unit 20 in the receiving space 13.

The studs 14 in the original shape extend through the respective stud holes 216. The engaging portions 221 of the engaging members 22 cooperate with the peripheral wall 12 of the key cap 10 to form the pivot engaging portions 224.

Step 3: heating and melting one end of each stud 14 such that the shape of each stud 14 is changed from the original straight tubular shape to a rivet shape, thereby riveting the base plate 21 to the key cap 10. Each stud 14 in the rivet shape has the shank portion 141, and the head portion 142 abutting against the lower side surface 214 of the base plate 21.

Step 4: engaging the balance bars 30 to the pivot engaging portions 224.

With the balance bars 30 engaged to the pivot engaging portions 224, the key device 100 of this disclosure can be stably assembled to a keyboard (not shown).

The engaging members 23, 24, 25 can provide pivot connection with an X-shaped link unit to further assemble the key device 100 to the keyboard.

With the engaging members 22, 23, 24, 25 being securely anchored to the base plate 21 through an injection molding process, after the base plate 21 is assembled to the key cap 10, the engaging members 22, 23, 24, 25 will not cause hindrance or interference to the assembly of the balance bars 30. Moreover, since the base plate unit 20 can be preformed, after the base plate 21 is assembled to the key cap 10, the studs 14 are simply heated to melt one ends thereof to fix the base plate 21 stably to the key cap 10 in a rivet manner. Thus, the making and assembly of the key device 100 of this disclosure are relatively easy.

In sum, the key device 100 of this disclosure has a reinforced structure, a simple overall structure, and easy to make and assemble, so that the manufacturing cost thereof can be reduced. Therefore, the object of this disclosure can indeed be achieved.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A key device comprising: a key cap made of plastic and including top wall and a peripheral wall extending downwardly from a periphery of said top wall and cooperating with said top wall to define a receiving space, said top wall having a plurality of spaced-apart studs protruding into said receiving space; and a base plate unit disposed in said receiving space and riveted to said top wall through said studs, said base plate unit including a base plate made of metal and a plurality of engaging members secured to said base plate, said base plate including a plurality of stud holes for extension of said studs respectively therethrough, and a plurality of spaced-apart anchor members, said engaging members being injection molded to said anchor members, respectively; wherein said base plate has an upper side surface abutting against said top wall, and lower side surface opposite to said upper side surface, said base plate further including a plurality of hollows extending through said upper and lower side surfaces, said anchor members being formed by stamping said base plate, each of said anchor members having a first plate portion connected transversely to said lower side surface, and a second plate portion connected transversely to said first plate portion and formed with an aperture, said second plate portion being spaced apart from said lower side surface and corresponding in position to a respective one of said hollows.

2. The key device as claimed in claim 1, wherein said first and second plate portions of each of said anchor members form an L-shaped in cross section.

3. The key device as claimed in claim 1, wherein each of said studs has a shank portion protruding from said top wall, and a head portion connected to said shank portion opposite to said top wall and abutting against said lower side surface of said base plate.

4. The key device as claimed in claim 1, wherein each of said engaging members has a first end face flush with said upper side surface of said base plate, and a second end face opposite to said first end said second plate portion of each of said anchor members being located between said first and second end faces of a respective one of said engaging members when each of said engaging members is injection molded to a respective one of said anchor members, said aperture of each of said engaging members bring configured to be filled with plastic material to anchor each of said engaging members to the respective one of said anchor members.

5. The key device as claimed in claim 1, wherein said base plate has two opposite long side edges, and two short side edges connected between said long side edges, each of said engaging members having an engaging portion, said engaging portions of some said engaging members being adjacent to said peripheral wall and cooperating with said peripheral wall to form a plurality of pivot engaging portions.

6. The key device as claimed in claim 5, further comprising two balance bars corresponding in position to said long side edges and pivotally engaged to said pivot engaging portions.

7. The key device as claimed in claim 5, wherein other ones of said engaging members located between said long side edges, said engaging portions of a portion of said other ones of said engaging members being C-shaped grooves, said engaging portions of another portion of said other ones of said engaging members being slide grooves, said engaging portions of the remaining portion of said other ones of said engaging members being hook rods.

* * * * *